US005377392A

United States Patent [19]

Morita

[11] Patent Number: 5,377,392

[45] Date of Patent: Jan. 3, 1995

[54] MAGNETIC FASTENING DEVICE

[76] Inventor: Tamao Morita, 47-1, Arakawa 6-Chome, Arakawa-ku, Tokyo 116, Japan

[21] Appl. No.: 43,484

[22] Filed: Apr. 6, 1993

Related U.S. Application Data

[63] Continuation-in-part of Ser. No. 898,608, Jun. 15, 1992, Pat. No. 5,253,394, and Ser. No. 899,979, Jun. 17, 1992, Pat. No. 5,199,138.

[30] Foreign Application Priority Data

Jun. 14, 1991 [JP] Japan ..... 3-169239
Jun. 17, 1991 [JP] Japan ..... 3-170396

[51] Int. Cl.[6] ..... A44B 11/26
[52] U.S. Cl. ..... 24/303
[58] Field of Search ..... 24/303, 49 M, 658; 292/251.5; 335/285

[56] References Cited

U.S. PATENT DOCUMENTS 1,296,427 3/1919 Ramshaw ..... 24/658

FOREIGN PATENT DOCUMENTS 1351339 12/1963 France ..... 24/303

*Primary Examiner*—James R. Brittain
*Attorney, Agent, or Firm*—Pennie & Edmonds

[57] ABSTRACT

A magnetic fastener is provided with a female member having a slide plate which engages with a recess portion of a projection formed in a cooperating male member. The projection is held in engagement with the slide plate via a permanent magnet formed in the projection. The female member has first and second plate members sandwiching the slide plate. The first and second plate members are held together by deforming the plate members or by welding. The first and second plate members and the slide plate each have an opening, the slide plate having a larger opening. The projection is inserted into the opening upon which one edge of the slide plate formed by the opening engages the recess portion and held thereto via the magnetic attraction. The male member can only be disengaged from the female member by pushing or pulling its engaged edge away from the projection.

15 Claims, 11 Drawing Sheets

MAGNETIC FASTENING DEVICE

This application is a continuation-in-part of application Ser. No. 07/898,608, filed Jun. 15, 1992 now U.S. Pat. No. 5,253,394 and application Ser. No. 07/899,979, filed Jun. 17, 1992 now U.S. Pat. No. 5,199,138.

BACKGROUND

The present invention provides a magnetic fastener usable for various types of bags such as shoulder and rucksacks, and for various types of boxes and belts, as well as for holding a door against a wall.

A fastener device that merely use the strength of the magnetic attraction to fasten mating parts does not operate properly when a force or an impact stronger than the attraction force of the permanent magnet is exerted on the male and female members, as the mating parts will disengage.

To overcome the defect, there has been proposed a fastener comprising a ferromagnetic female member which has a hole for receiving a projection of a male member. The projection has an enlarged head and a permanent magnet at the base of the projection. With this type of fastener means, the female member is attracted by the permanent magnet of the male member when the projection of the male member is inserted in the hole of the female member to effect tentative engagement between the two members. By twisting the projection, the enlarged head of the projection is disposed on a plate portion near the periphery of the hole in the female member to firmly lock the two members.

Although firm engagement of the male and female members is achieved in this type of fastener means, it is rather troublesome to twist the projection of the male member every time it is inserted in the female member, and more particularly, to pull the two members apart in addition to twisting the projection of the male member for detaching the two members.

In view of the foregoing, various improvements have been proposed to provide a fastener means which is easy in manipulation. The fastener means proposed by JP Publication No. Hei 3-14983 is a typical example.

In JP 3-14983, the projection of the male member has a laterally extending head portion which is either made of or provided with a permanent magnet. The female member has a hole for receiving the projection of the male member, and when the projection of the male member is inserted therein, a ferromagnetic plate slideably incorporated in the female member is attracted to the projection, so that the ferromagnetic plate becomes locked with said laterally extending portion of the projection when a force is exerted to pull the male member out of the female member.

The fastener of this type is still defective in that component parts of the fastener are not necessarily easy to assemble, and the appearance of the fastener means is not quite appealing.

SUMMARY OF THE INVENTION

The primary object of this invention is to provide a magnetic fastener having a simplified structure with reduced number of component parts.

Another object of the present invention is to provide an improved magnetic fastener without the deficiencies of the prior magnetic fasteners.

Another object of this invention is to enable accurate assembling of the component parts of the female member, so that the slide plate incorporated in the female member can perform its function accurately.

More particularly, the present invention provides an improved magnetic fastener which comprises a male member having a permanent magnet, a female member having a ferromagnetic slide plate which engages with said male member by magnetic attraction.

Moreover, the magnetic fastener according to the present invention is characterized in that there is provided an interval to allow smooth and secure movement of the female member slide plate, and that when a projection formed in the male member is inserted into the female member, the slide plate is smoothly and securely attracted toward the projection. The construction of the present fastener is such that the female member having the interval for allowing smooth and secure sliding of the slide plate can be easily formed.

The present magnetic fastener, which utilizes the attraction force of a permanent magnet, is advantageous in that it is easy to use as the female member is easily attracted to and detached from the male member. The present fastener is relatively simple in structure and can be used for wide variety of purposes such as handbags, rucksacks, shoulder bags, brief cases, trunks and belts and other similar fastening purposes.

These and other objects of the present invention will become apparent from the following description.

BRIEF DESCRIPTION OF THE DRAWINGS

FIG. 7 showing the projection E of the male member A-1 as it is being inserted, and FIG. 8 the projection E as it is fully inserted.

DETAILED DESCRIPTION OF THE DRAWINGS

Figure 1:
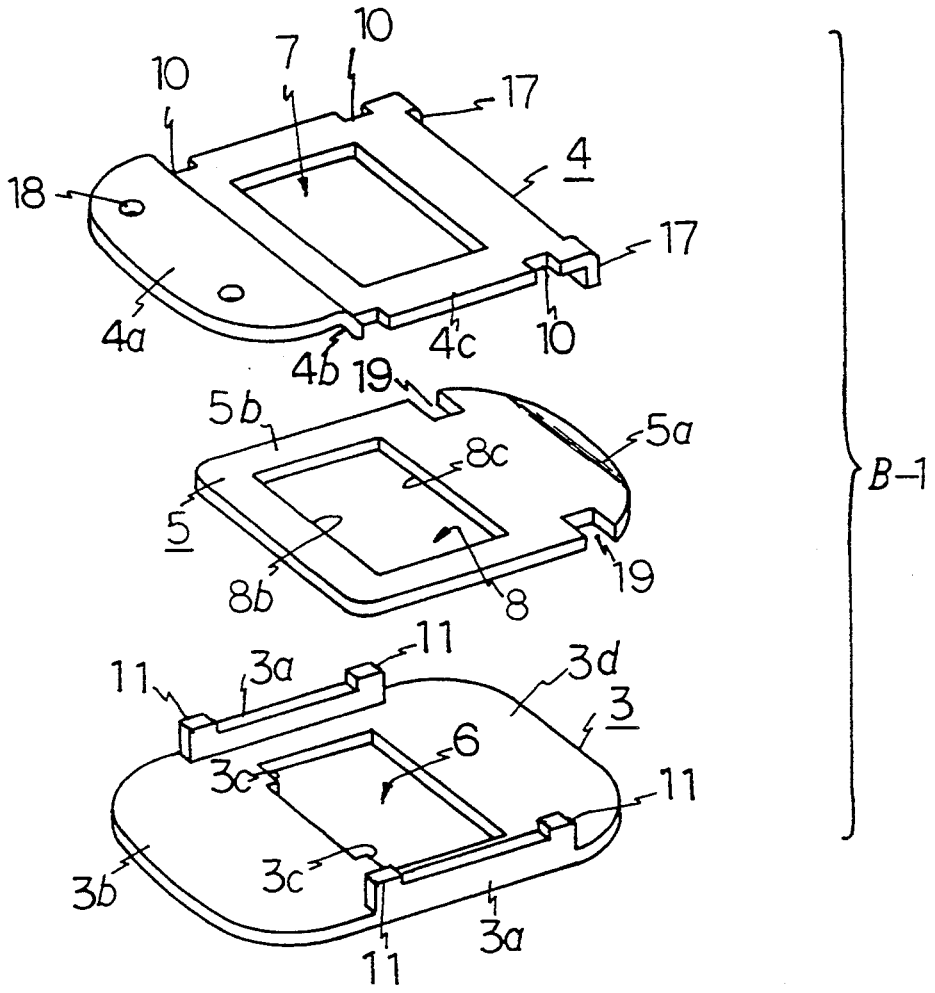
FIG. 1 is an exploded perspective view showing the component parts of a female member B-1 according to the first embodiment of the present invention.

The male member A and the female member B will now be described in more detail by way of various embodiments. Same reference numerals have been designated to each embodiments for identifying the same elements.

The male member A-1 and the female member B-1 according to the first embodiment shown in FIGS. 1 through 8 will now be described. The male member A-1 has a projection E which includes a shaft 2 made of non-ferromagnetic material and a permanent magnet 1 incorporated in the shaft 2.

The shaft 2 has an inner cavity which extends from the bottom of the projecting portion 2*a* toward the head, the projection portion 2*a* being substantially rectangular in plan view. The vertical section of said head is arc-shaped to allow smooth insertion into the female member B-1.

An engagement recess or opening 12 (hereafter also called "window") is formed between a jaw 9 and a stepped portion 13 which are provided substantially along the length of the projection E. A space between the stepped portion 13 and the jaw 13 defines the engagement recess 12. The stepped portion 13 is provided at the base of the portion 2*a*. A seat 2*b* extends laterally and integrally from the periphery of the base of the portion 2*a*. An edge 2*c* extends downwardly from the periphery of the seat 2*b*. A boss 2*d* is provided at the bottom of the seat 2*b* surrounded by the edge 2*c* to act as a fixing means for a leg member 14.

The leg member 14 includes leg strips 14*a*, 14*a* that are inserted in the opening of a washer 15 and bent for engaging the male member A-1 to the base material C, such as a leather material of a bag to which the fastener means is to be attached. The leg member 14 is constructed so that it fits in a dent formed at the bottom of the seat 2*b* to shield the cavity in the projection shaft 2. An aperture is formed in the leg member 14, so that said boss 2*d* will project from the aperture when the leg member 14 is tightly fixed at the bottom of the seat 2*b*. The boss 2*d* is pressed against the face of the leg member 14 to allow the leg member 14 and the projection shaft 2 to become engaged.

A permanent magnet 1 and a ferromagnetic plate 16 are fitted in the projection shaft 2 thus assembled. The leg member 14 is also fitted to the seat 2*b* of the shaft 2. The permanent magnet 1 and the ferromagnetic plate 16 are thus firmly fitted inside the projection shaft 2 to form the male member A-1 having the projection E. The male member A-1 is then attached to the base material C. The leg strips 14*a* of the member A-1 are inserted in the base material C, and the washer 15 is fitted over the leg strips 14*a*. The leg strips 14*a* are bent toward the base material to firmly fix the member A-1 to the base material C.

It is noted that the ferromagnetic plate 16 acts to effectively attract the slide plate 5 which is described below. The plate 16 is preferably exposed via the window 12 provided in the projection portion 2*a* of the shaft 2. The stepped portion 13 provided at the projecting portion 2*a* functions to engage the projection E and the female member B-1 firmly.

The projection E of the male member A-1 comprises the projection shaft 2 and the permanent magnet 1. The permanent magnet 1 is made of, for example, a ferrite magnet and is covered by the projection shaft 2. It was previously indicated that the projection shaft is made of non-ferromagnetic material. However, the male member A as a whole except for fixing means such as the leg member 14 can be also be made of a permanent magnet such as a plastic magnet. In this case, the amount of magnetism of the male member A would be greater than that of the male member with non-magnetic projection shaft having the same bulk. Accordingly, the projection shaft made of a permanent magnet or magnetic material can be made smaller.

It is also possible to use a ferromagnetic material to construct the projection shaft 2. This construction prevents leakage of magnetism from the permanent magnet 1 placed inside the projection E.

When the ferromagnetic plate 16 is provided on the side of the window in the shaft 2 as mentioned above, the ferromagnetic plate 16 acts to cover the window to shield the permanent magnet 1 inside, as well as to converge the magnetic field of one of the magnetic poles of the magnet 1, enabling the slide plate 5 of the female member B-1 to be firmly and stably attracted.

It is also possible to use the permanent magnet 1 alone without the ferromagnetic plate 16. Instead of providing the window, the cavity for receiving the permanent magnet 1 can be made a blind hole.

A ferromagnetic plate may be disposed at each magnetic pole of the permanent magnet 1. The ferromagnetic plates at the magnetic poles may be extended to reach the side face of the permanent magnet. This prevents leakage of magnetic flux. The magnetic poles of the permanent magnet 1 may be disposed vertically with respect to FIG. 5.

The construction of the engagement recess 12 to be provided on the projection E may be such that the upper face of the slide plate 5 of the female member B-1 would abut against the jaw 9 of the recess 12 when the slide plate 5 is attracted to the surface of the projection E located below the jaw 9. When the slide plate 5 of the female member B-1 is attracted to the jaw 9, the male and female members A and B become firmly engaged.

Although the engagement recess 12 is provided in the projection E so that the side end of the slide plate 5 attracted inside the recess 12 abuts against the jaw 9 located at the upper edge of the recess 12, it is also possible to provide the jaw 9 alone in the projection E and omit the stepped portion 13.

Figure 9:
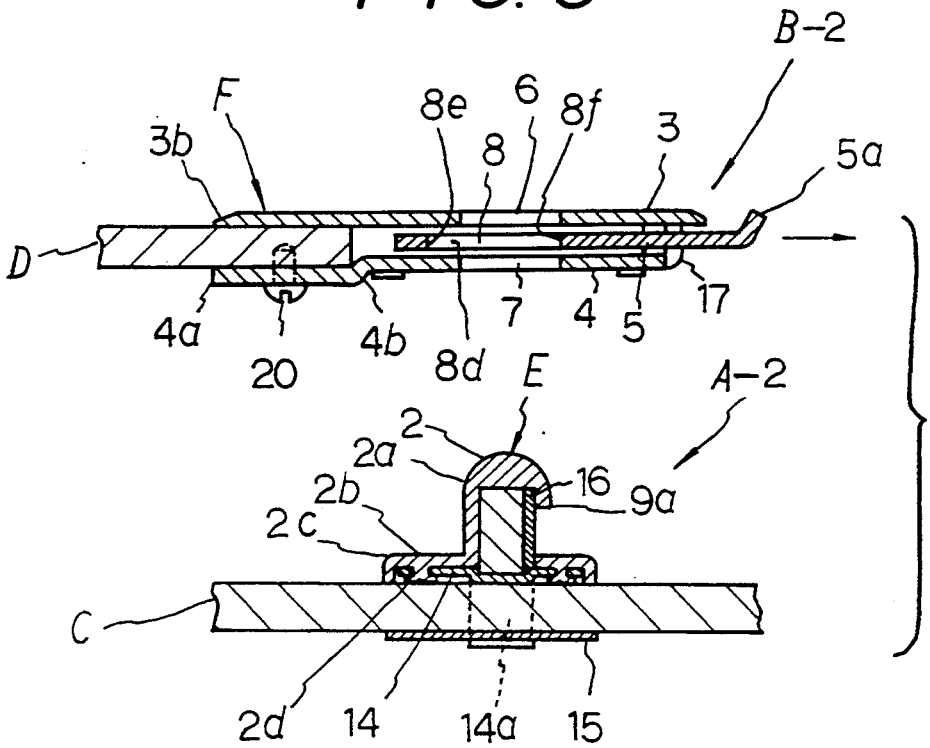
FIG. 9 is a sectional view showing a second embodiment of the present magnetic fastener before the male and female members engaged.

In other words, an engagement strip 9*a* as shown in FIG. 9 may be protruded so that the upper end face of the slide plate 5*a* can be engaged with the strip 9*a*. Alternatively, the engagement strip 9*a* may be a flange projecting from the projection E. Still alternatively, the engagement strip 9*a* may be formed as a pin or a small projection protruding from the projection E.

The leg member 14 may be made of a ferromagnetic material to prevent leakage of the magnetic flux from the permanent magnet 1. The leg member 14 may also be made of a non-ferromagnetic material, in which case the leg strips 14*a* do not act as a passage for the magnetism from the permanent magnet 1 to reach the washer 15 attached to the base material C.

The female member B-1 of the embodiment shown in FIGS. 1–8 will now explained below.

The female member B-1 includes a female frame F comprising a first plate 3 and a second plate 4, and a slide plate 5 made of a ferromagnetic material slideably sandwiched between said first and the second plates 3 and 4.

The slide plate 5 is preferably made of a material that can be effectively attracted by the permanent magnet 1, such as so called ferromagnetic material which has an excellent magnetic permeability.

The first and the second plates 3 and 4 may be made of a material such as metals and plastics that would allow the plates to be firmly connected by various welding methods or deformation of catches 11 as described below. The first and second plates 3 and 4 may be either ferromagnetic or non-ferromagnetic.

If the first and the second plates 3 and 4 of the female frame F are made of a non-ferromagnetic material, the projection E of the male member A-1 can be easily inserted in the female member B-1 and the movement of the slide plate 5 can be made smooth and accurate.

If these plates 3 and 4 are made of a ferromagnetic material, magnetic leakage from the fastener means when the male and the female members are engaged can be prevented.

When the second plate 4 is made of a ferromagnetic material, the female frame F can be firmly attracted to the permanent magnet 1 of the male member A-1 regardless of whether the first plate 3 is ferromagnetic or non-ferromagnetic.

The first plate 3 will now be explained with respect to the embodiment of FIGS. 1–8.

The first plate 3 includes opposing sides 3*a*, 3*a* formed by bending the opposed sides of the plate, so that the slide plate 5 can be slideably inserted between the two opposing sides. Catches 11 extend upward from the upper edges of the sides 3*a*. The catches 11 may be provided in any number of places depending on the shape and the size of the female frame F. The width may also be selected as desired.

Figure 2A:
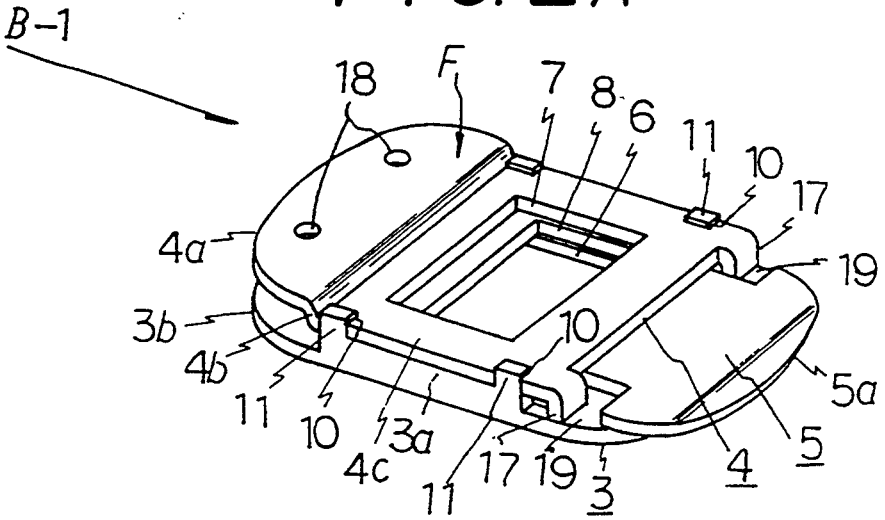
FIG. 2A is a perspective view of the female member B-1 with the catches 11 being deformed.
Figure 3B:
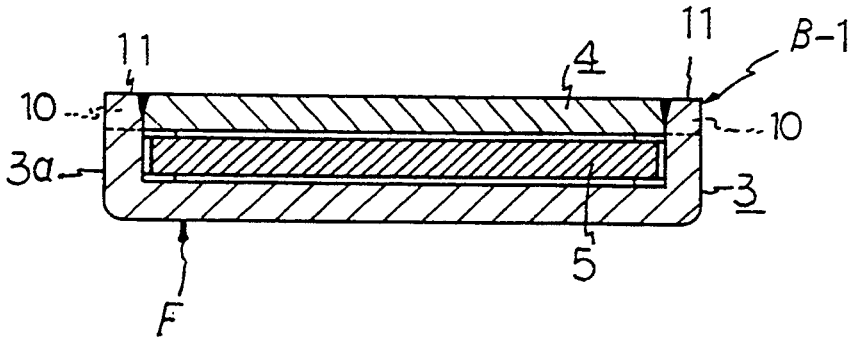
FIG. 3B is a sectional view showing welding of catches with recess 10.
Figure 4B:
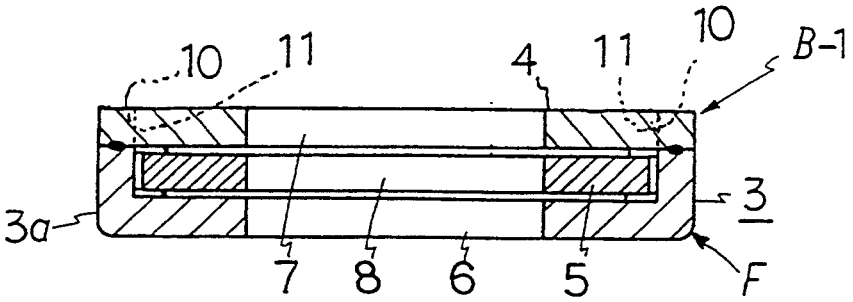
FIG. 4B is a sectional view showing welding on sides of the female member.
Figure 3A:
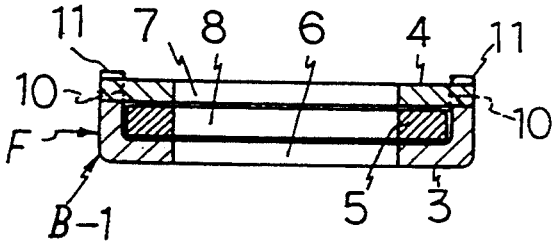
FIG. 3A is a sectional view showing catches 11 before they are deformed.
Figure 4A:
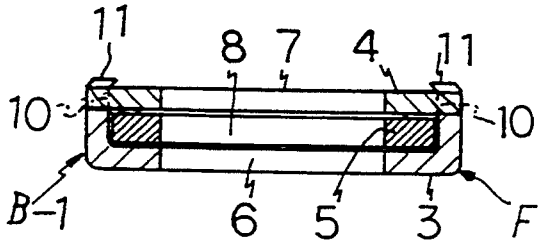
FIG. 4A is a sectional view showing welding on sides the catches after they are deformed.

With respect to FIGS. 2A, 3A and 4A, the catches 11 preferably project from the upper edge of the sides 3*a* for a length slightly greater than the thickness of the second plate 4 so that the catches 11 protrude beyond the outer surface of the second plate when engaged therewith. This allows the upper portions of the catches 11 to be more easily deformed, as shown in FIG. 4A, to achieve firm engagement of the first and the second plates 3 and 4.

Figure 2B:
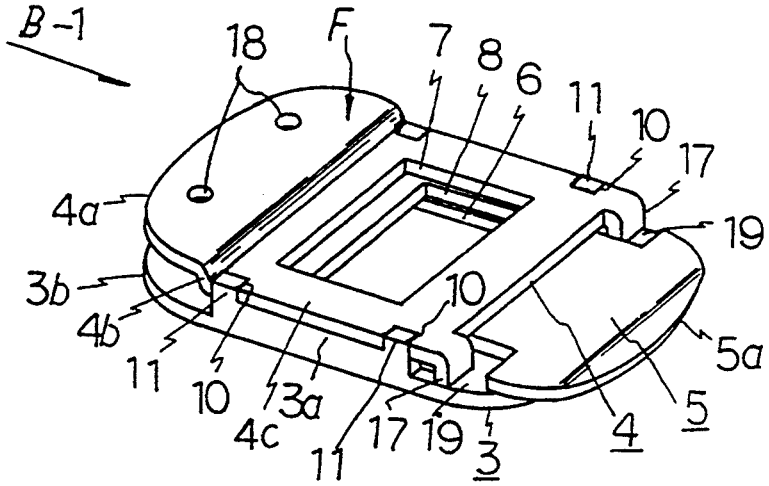
FIG. 2B is a perspective view of the female member B-1 with the catches 11 welded.

Alternatively, with respect to FIGS. 2B, 3B and 4B, the catches may be formed at the same height or slightly shorter than the thickness of the second plate 4. This arrangement enables the catches 11 to be conveniently fitted in the recess or slot 10 further described below, to achieve firm engagement between the first the second plates 3 and 4.

Further, there is provided an opening 6 in the first plate 3 through which the projection E of the male member A-1 is inserted. There are also included plate portions 3*b* and 3*d* which extend beyond the length of the sides 3*a*. One of the portions 3*b* is used to fix the fastener means to the base material D of a bag such as leather.

Catches 3*c*, 3*c* are also provided at the periphery of the opening 6 on the side of the portion 3*b*, so as to retain the head of the projection E in place when the projection E is inserted in the opening 6.

The second plate 4 will be explained below with respect to FIGS. 1–8.

The second plate 4 includes a portion 4*a* which corresponds to the portion 3*b* of the first plate 3, the portion 4*a* extending beyond a bent portion 4*b*. Recesses or slots 10 are provided on both sides of the portion 4*c* on sides 3*a* of the first plate 3 to receive each catch 11 of the first plate 3. On the opposite side of the portion 4*a*, there is provided an engagement strip 17 each which is bent downward to contact the face of the plate 3.

The slots 10 provided in the second plate 4 preferably has the depth substantially the same as the plate thickness of the side 3*a*, so that the plates 3 and 4 when connected, will have a streamlined appearance.

There are provided through-holes 18 for permitting insertion of screws or the like on the plate portion 4*a*, while an opening 7 which communicates with the opening 6 in the first plate 3 is provided in the plate portion 4*c*. The opening 7 has a size that will loosely receive the base of the projection E of the male member A-1.

The slide plate 5, with respect to FIGS. 1–8, which is inserted between the first and the second plates 3 and 4 is explained below.

The slide plate 5 also has an opening 8 which is wider than the openings 6 and 7 in longitudinal direction, i.e., between the side walls 3*a*, 3*a*. The slide plate 5 further includes a plate portion 5*b* which fits inside the sides 3*a* and 3*a* of the first plate 3, and a slightly curved lip member 5*a* for manipulation, which projects slightly beyond the edge of the first and second plates 3 and 4 when the first and the second plates 3 and 4 are connected. On the edges extending between the manipulation lip member 5*a* and the plate portion 5*b* is provided a groove 19 in which said engagement strips 17 of the plate 4 rest respectively.

The slide plate 5 to be inserted in the female frame F is provided on the side of the lip member 5*a* with an opening 8*a* which is wider than the openings 6 and 7 of the first and the second plates 3 and 4 respectively. The slide plate 5 is preferably pressed into the female frame F in such a manner that the periphery 8*b* of the opening 8 on the side opposite the lip member 5*a* will substantially come in alignment with the peripheries of the holes 6 and 7 of the first and the second plates 3 and 4 respectively.

To achieve this positional relation of the slide plate 5 and the female frame F, the engagement strips 17 and the grooves 19 must be provided in advance at respectively appropriate positions.

Assembling of the female member B-1 comprising the above mentioned component parts is explained below.

The slide plate 5 is first placed in between the sides 3*a*, 3*a* of the first plate 3 at a position such that the manipulation lip member 5*a* will project slightly outside from the portion 3*d*.

The second plate 4 is then placed over and between the sides 3*a*, 3*a*, so that the catches 11 provided on the sides 3*a* will be fitted in the slots 10 of the second plate 4. In doing so, care is taken to make the engagement strips 17 of the plate 4 rest in the grooves 19 of the slide plate 5.

Then, the catches 11 fitted inside the slot 10 are deformed toward each other as shown in FIGS. 2A, 3A and 4A. The deformed catches are deformed to press against the upper surface of the second plate 4 and firmly hold the first and second plates 3 and 4 together.

The catches 11 may be made longer in order to allow the same to be bent at respective upper end toward the upper face of the second plate 4.

Still further, the catches 11 may be such that the entire or part of each catch 11 becomes compressed inside the slots 10 and pressed firmly against the inner wall thereof. When the catches are to be compressed inside the slots 10, they must be sufficiently compressed to allow firm engagement between the first and the second plates 3 and 4.

Alternatively, the first and the second plates 3 and 4 are assembled by fitting said catches 11 into the slots 10, and then welded together in assembled state as shown in FIG. 3B. Alternatively, the first and second plates 3 and 4 may be stably assembled by engaging the catches into the slots 10, and then finally fixed by welding the upper ends of the sides 3*a* of the first plate 3 with the face of the second plate 4 contacting thereto, as shown in FIG. 4B.

Still alternatively, the first and second plates 3 and 4 may be welded on the portions where the first and the second plates contact other than the above described locations. Although the two plates are welded on the surfaces thereof which contact each other as shown in solid black in FIGS. 3B and 4B, they may be welded on the sides of the contacting surfaces or the sides of the plates. Further, they need not be welded along the entire contacting portions, but may be partly welded so long as they do not become separated.

The welding method used herein for fixing includes well-known methods such as melt welding, pressure welding, diffusion welding and braze welding, and typically resistance welding such as spot welding, arc welding, and brazing.

With the female frame F of the above construction, the slide plate 5 will not slip out because the engagement strips 17 rest in the grooves 19 of the slide plate 5 with the manipulation lip member 5*a* protruding slightly outside from the frame F, as well as because the slide plate 5 is slideably inserted in between the first and the second plates 3 and 4.

The opening 6 in the first plate 3, the opening 7 of the second plate 4 and the opening 8 of the slide plate 5 inserted inside the female frame F all communicate with one another so as to allow the projection E of the male member A-1 to be freely inserted/removed. The openings 6 and 7 respectively have a size that will allow the projection E to be fitted. The openings are also large enough to receive the projection E without play.

The slide plate 5 slideably inserted in the female frame F has an opening 8*a* on the side where the manipulation lip member 5*a* is provided, the opening 8*a* being wider than the openings 6 and 7 in the direction of the lip member 5*a*. Further, the periphery 8*b* of the opening 8 on the opposite side of the lip member 5*a* protrudes outward from the openings 6 and 7. See FIG. 5.

The female member B-1 of the above construction is attached to the base material D by means of a screw 20 or like as base material D is inserted in between the portion 3*b* of the first plate 3 and the portion 4*a* of the second plate member 4 to reach the bent portion 4*b*.

Figure 5:
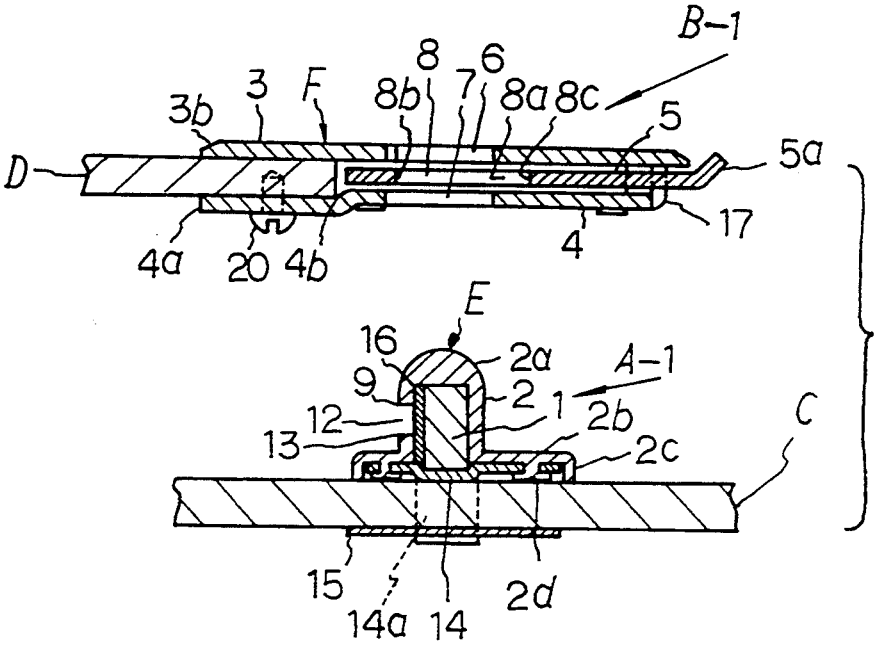
FIG. 5 shows the cross section of the male and female members before engagement thereof.
Figure 6:
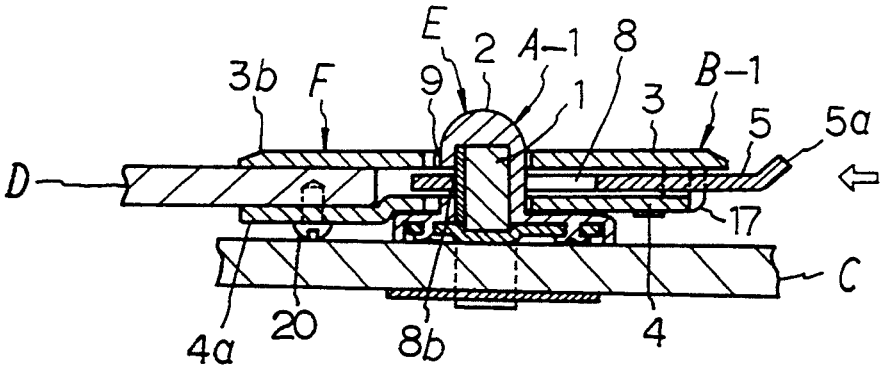
FIG. 6 shows the cross section of the male and female members being engaged.
Figure 7:
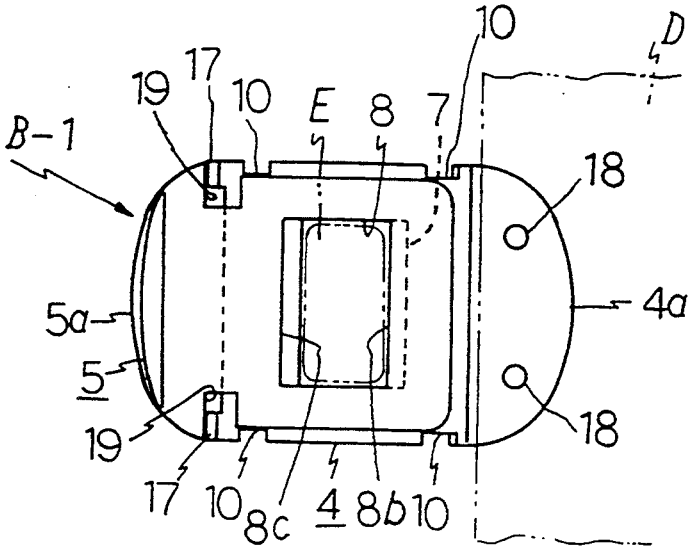
FIGS. 7 and 8 show the movements of a slide plate 5 when the male member A-1 is inserted into the female member B-1, with the first plate member 3 shown removed.
Figure 8:
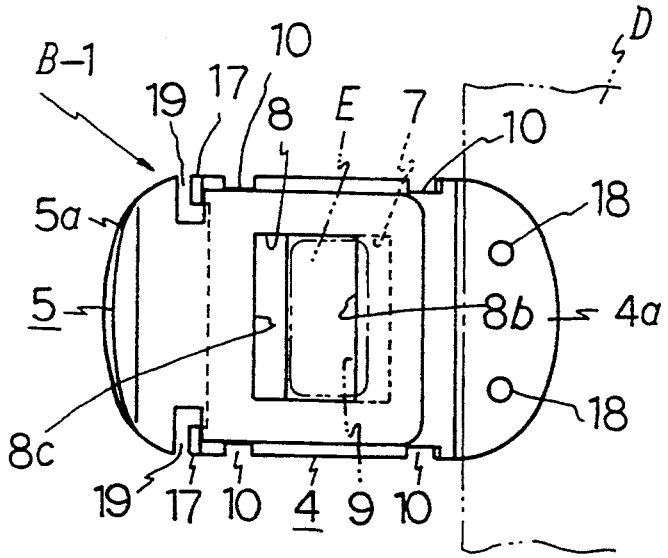

The male member A-1 and the female member B-1 are assembled as shown in FIGS. 5 and 6.

The male member A-1 is released from the female member B-1 as the slide plate 5 is pressed inwardly, and attracts the female member B-1 in a manner to make the lip member 5*a* of the slide plate 5 project outwardly.

As a result, the male member A-1 is engaged with the female member B-1 with the recess 12 for engagement provided in the projection E facing opposite the direction the lip member 5*a* of the female member B-1 is protruding.

By attaching the male member A-1 to the female member B-1 as shown in FIG. 6, one of the peripheral edges 8*b* of the opening 8 in the slide plate 5 is attracted by the permanent magnet 1 of the projection E with a force greater than that acting on the other peripheral edge 8*c* across the hole 8*a*. By providing the window 12 for engagement in the projection E on the side of this peripheral edge 8*b*, the peripheral edge 8*b* of the slide plate 5 will be able to be attracted to the face of the projection E inside the window 12.

As a result, if the male member A-1 is pulled out from the female member B-1, the projection E will move in the pulling direction with the slide plate 5 attracted thereto. As the jaw 9 of the window 12 abuts against the upper face of the peripheral edge 8*b*, the male member A-1 will be prevented from slipping out.

When the male and the female members are in such an engagement, they can only be disengaged from each other by pulling them apart while moving the slide plate 5 which is attracted to the projection E inside the window 12 in the direction of arrow in FIG. 6, or moving the plate in the direction away from the window.

Referring to FIG. 9, the fastener according to the second embodiment is explained below.

The component parts of the male and the female members A-2 and B-2, respectively, according to the second embodiment are substantially identical to those of the first embodiment. The parts having the same functions are denoted by the same reference numbers, and explanation is omitted.

The male member A-2 according to this embodiment is provided with an engagement strip 9*a* that extends laterally at the head of the projection E. The engagement strip 9*a* functions in the same manner as the engagement window 12 in the projection E of the male member A-1 of the first embodiment. In other words, the projection E in the male member A-2 has a bulging portion 9*a* at the head of the projection E as shown in FIG. 9, and the edge of the slide plate 5 will be attracted to the face of the projection E located below this engagement strip 9*a*. It should be noted that the engagement strip 9*a* is not limited to the one shown in the figure. For instance, a flange may be provided to extend from the projection E. The engagement strip 9*a* may be formed as a pin or the like extending from the projection E.

The peripheral edges 8*e*, 8*f* of the opening 8 in the slide plate 5, the opening 6 of the first plate 3 and the opening 7 of the second plate 4 of the female frame F are in an inverted relation with respect to the first embodiment. More particularly, when the slide plate 5 is pulled outwardly, the peripheral edge 8*f* of the opening 8 on the side of the manipulation lip member 5*a* becomes aligned with or projects slightly toward the peripheral edges of the openings 6 and 7. The peripheral edge 8*e* on the opposite side is separated from the openings 6 and 7 by means of the portion 8*d* which is laterally wider.

By connecting the male member A-2 and the female member B-2 in a reverse direction to that employed in the first embodiment, i.e. by arranging the engagement strips 9a of the projection E to face the manipulation lip member 5a, engagement/disengagement of the male and the female members is manipulated in the reverse manner. The slide plate 5 of the female member B-2 is attracted inward by the projection E when the male member A-2 is inserted in the female member B-2, with the peripheral edge 8f attracted to the projection E. When the projection E is pulled in the direction of disengagement, the upper face of the peripheral edge 8f abuts against the engagement strip 9a to prevent the projection E from slipping out.

By pulling the slide plate 5 in the direction of disengagement (in the direction of an arrow in FIG. 9) while the male and the female members are in engagement, the male and the female members can be pulled apart and become disengaged.

Figure 11A:
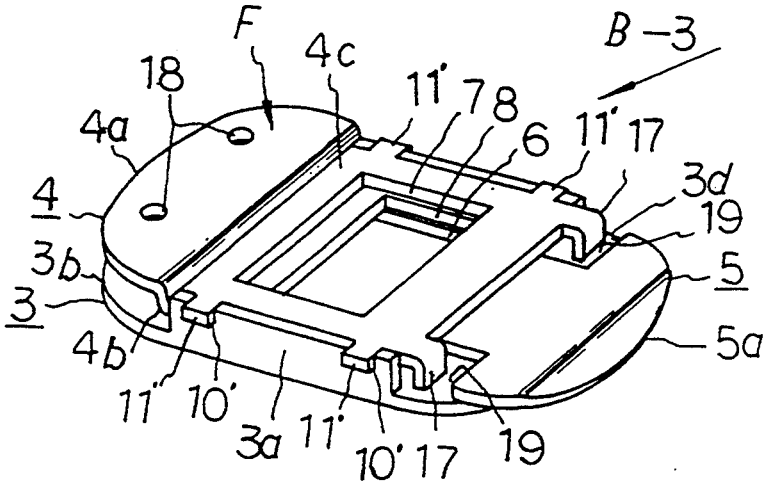
FIG. 11A is a perspective view of the female member B-3 of the third embodiment with the catches 11' being deformed.
Figure 10:
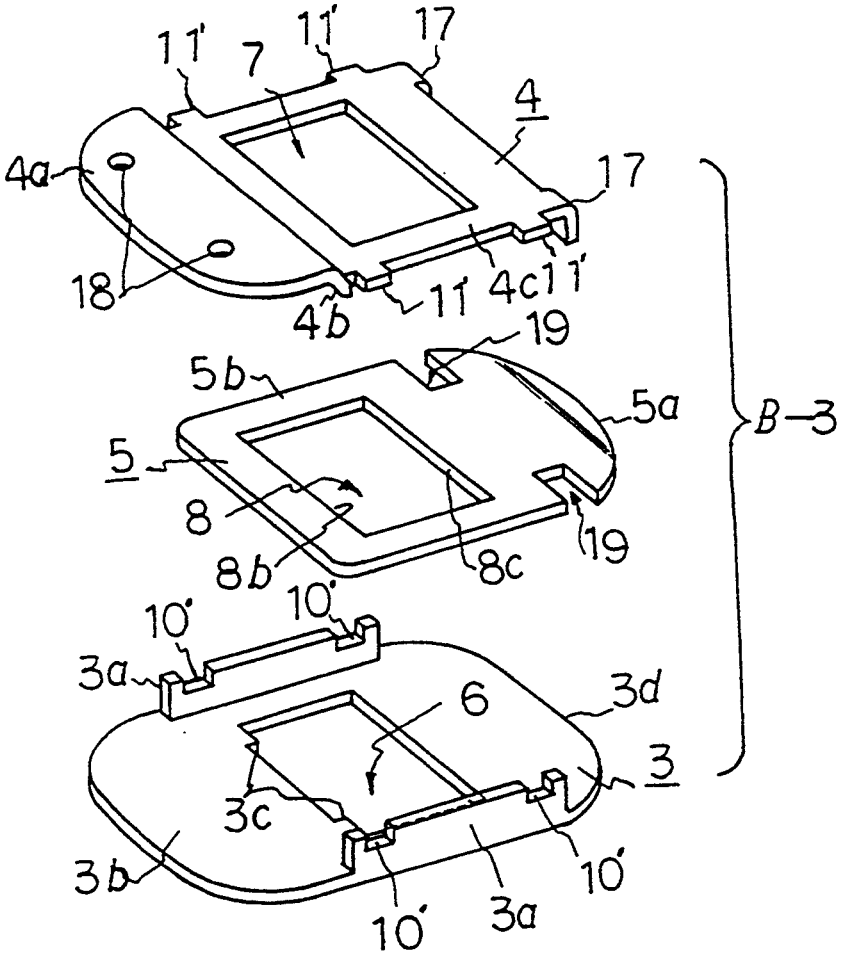
FIG. 10 is an exploded perspective view showing the component parts of a female member B-3 according to the third embodiment of the present magnetic fastener.
Figure 11B:
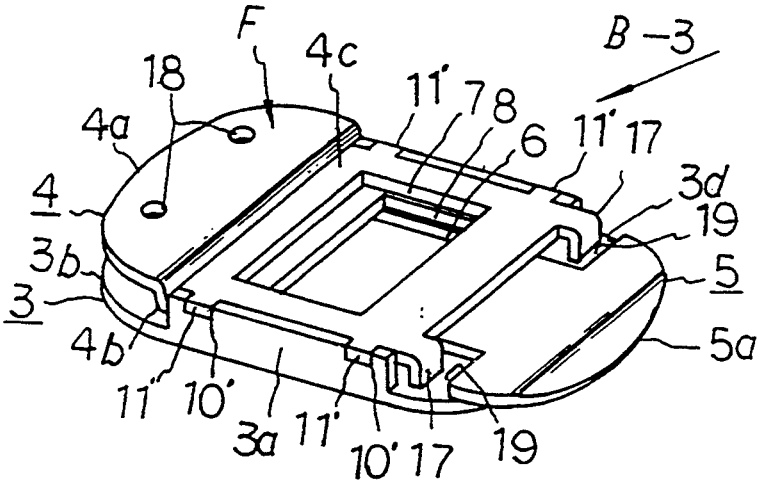
FIG. 11B is a perspective view of the female member B-3 with the catches 11' welded.
Figure 12:
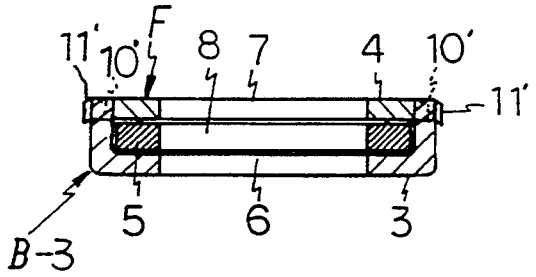
FIG. 12 is a cross sectional view of FIG. 11A, showing the deformed catches 11'.
Figure 13:
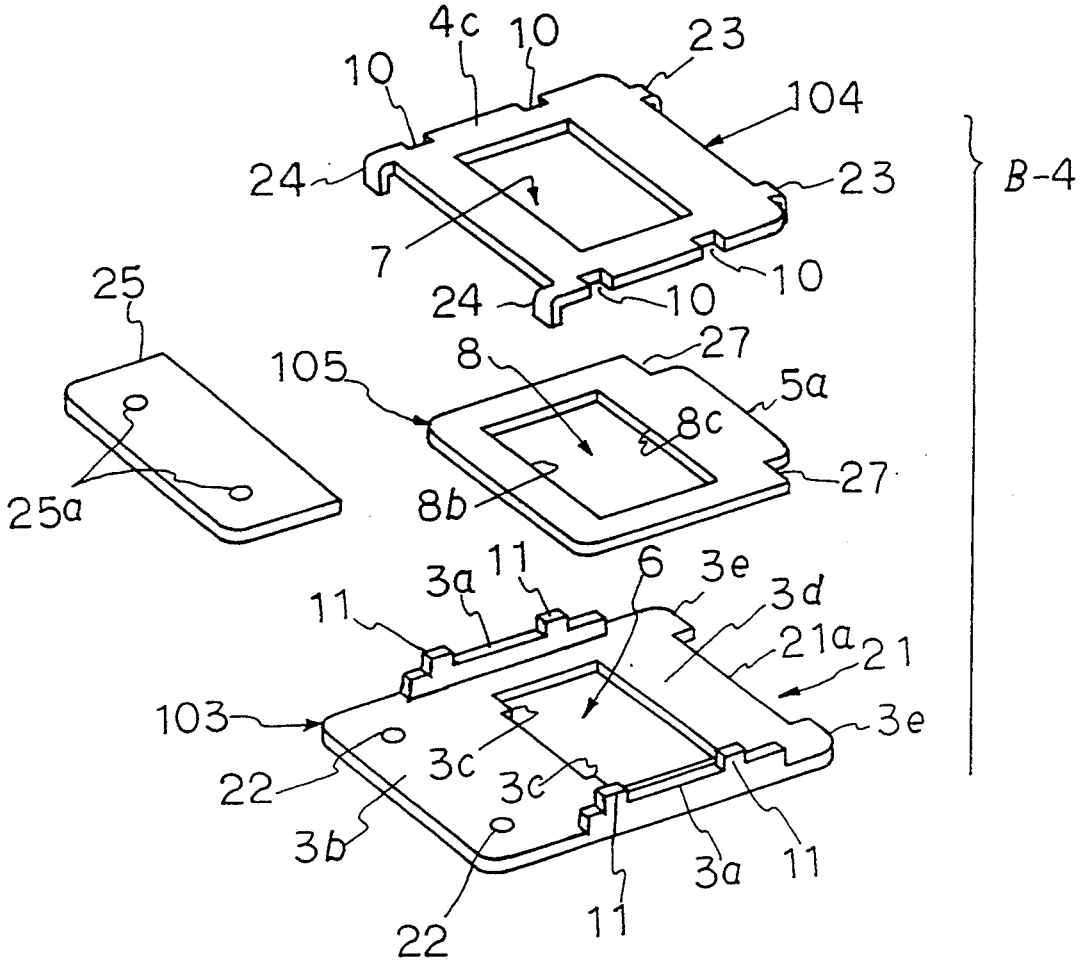
FIG. 13 is an exploded perspective view showing the component parts of a female member B-4 according to the fourth embodiment of the present magnetic fastener.
Figure 14A:
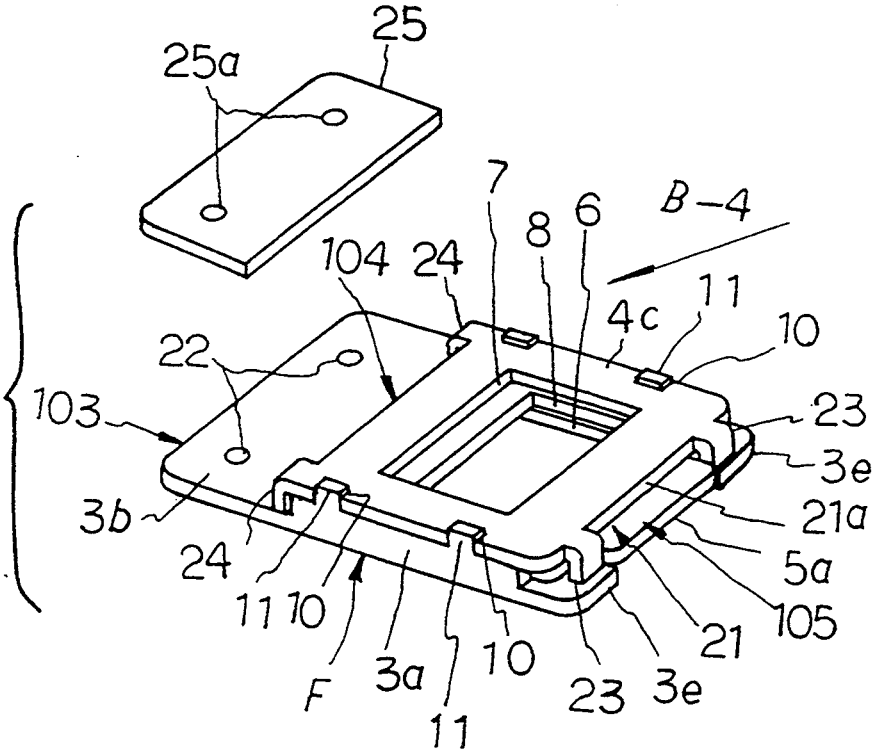
FIG. 14A is a perspective view of the female member B-4 of the fourth embodiment with the catches 11' being deformed.
Figure 14B:
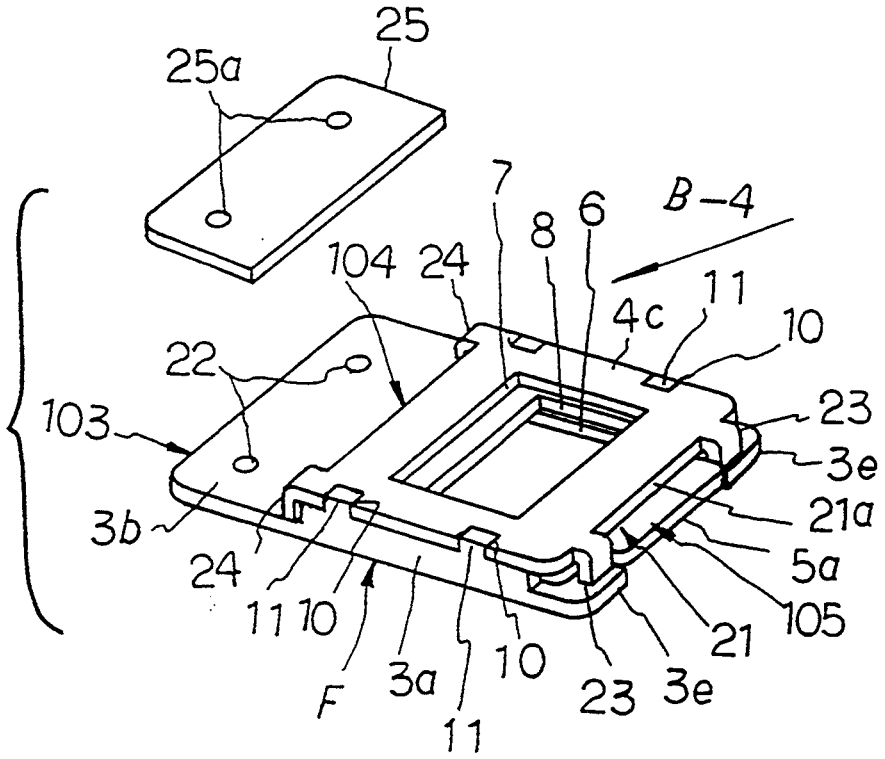
FIG. 14B is a perspective view of the female member B-4 with the catches 11' welded.
Figure 15:
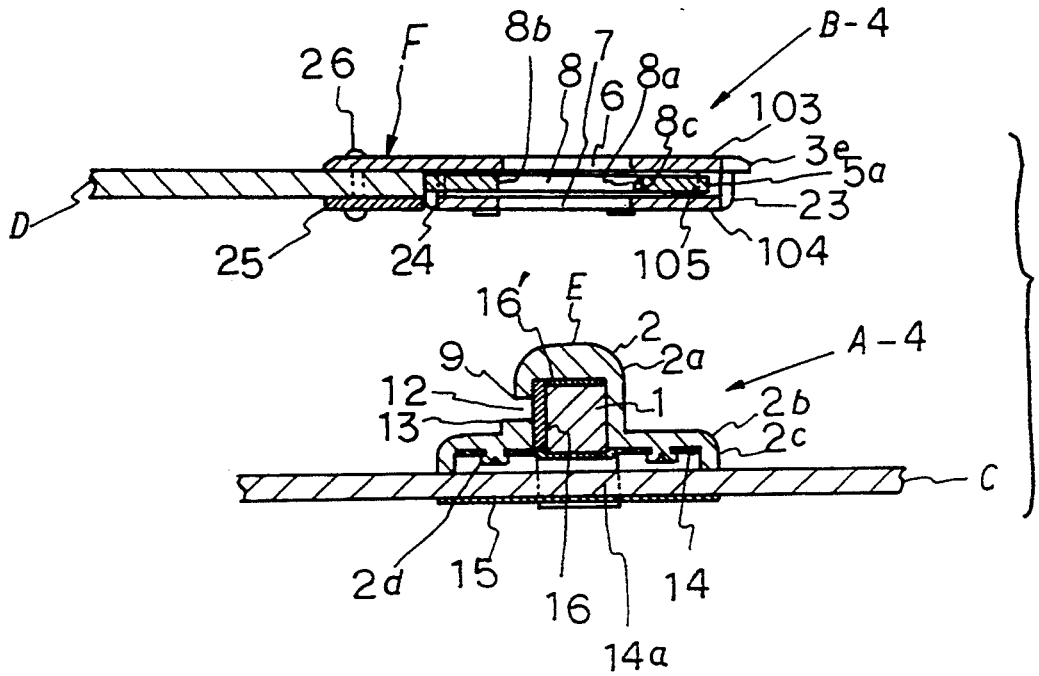
FIG. 15 shows the cross section of the male and female members of the fourth embodiment before engagement thereof.
Figure 16:
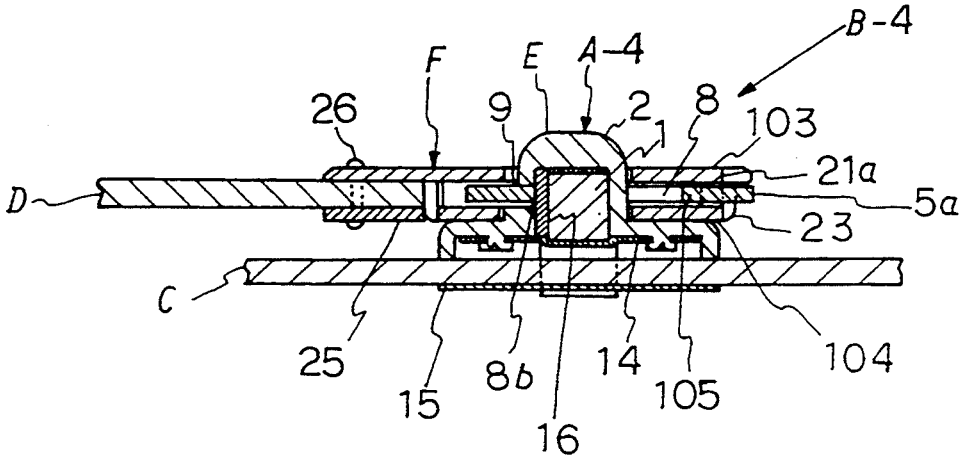
FIG. 16 shows the cross section of the male and females members of the fourth embodiment being engaged.

Referring to FIGS. 10–12, the fastener according to the third embodiment is explained below.

The female member B-3 according to the third embodiment is substantially identical in construction with the first embodiment except that the slots 10' are provided on the sides 3a of the first plate 3 rather than on the second plate 4. Catches 11' which fit in the slots 10' project from the side edge of the second plate 4. Component parts having identical functions are denoted with the same reference numbers and description thereof is omitted.

According to the third embodiment, the slide plate 5 and the second plate 4 are attached to the first plate 3 of the female member B-3 in the same manner as in the first embodiment.

By fitting the catches 11' fitted in the slots 10' of the first plate 3 to deform, the first plate 3 and the second plate 4 are firmly engaged, as shown in FIGS. 11A and 12.

The catches 11' can be deformed in exactly the same manner as in the first embodiment. For example, FIG. 12 shows a typical mode. The catches 11' are slightly bent toward the sides 3a at the tip end to thereby hold the plates 3 and 4 in firm engagement.

By somewhat increasing the length of the catches 11', the catches 11' may be bent fully on the sides 3a. If the catches 11' become totally or partly deformed within the slots 10', the catches 11' will press against the slots 10' to hold the two members in engagement.

Alternatively, the fixing of the first and second plates 3 and 4 by welding may be performed according to the same technique and mode of operation as those used for the first and the second plates of the female member B-1 of the first embodiment.

With respect to FIG. 11B, the catches 11' fitted in the slots 10' of the first plate 3 may be welded to the slots 10', or the side faces of the sides 3a may be welded to the sides of the second plate 4 which contact the sides 3a. Welding may be performed on parts other than mentioned above.

The female member B-3 of the third embodiment is used in the same manner as in the first embodiment and the male member is identical in construction with the male member A-1. Illustration thereof is therefore omitted.

Referring to FIGS. 13–16, the magnetic fastener according to the fourth embodiment is explained below.

The fastener according to the fourth embodiment is essentially the same as that of the first embodiment except that the male member A-4 and the female member B-4 are modified, and the ferromagnetic plate 16 is further provided with a ferromagnetic plate 16'. Component parts having the identical functions are denoted with the same reference numbers and description is omitted except for those that are modified.

The first plate 103 forming the female frame F includes sides 3a, 3a, an opening 6 into which the male member A-4 is inserted, catches 3c at the corners of the opening 6, and holes 22 provided on the side of the portion 3b. Lobes 3e project from both edges of the portion 3d to define a dent portion 21. Catches 11 are provided on the sides 3a which fit in the slots 10 of the second plate 104.

The second plate 104 includes an opening 7 into which the male member A-4 is inserted. The plate 104 is constructed so that it can be attached to the first plate 103 between its sides 3a, 3a. The slots 10 are provided on the sides to receive the catches 11. Stopper strips 23, 24 which are bent downward to reach the first plate 103 are also provided.

The stopper strips 23, 24 are provided on the sliding side of the slide plate 105, which in turn is to be inserted between the first and the second plates 103 and 104 of the female frame F. The stopper strips 23, 24, together with the sides 3a, 3a of the first plate 103 act to prevent the slide plate 105 from slipping out.

The stopper strips 23, 23 are provided at the corners of the plate 105 at an interval that will allow the manipulation lip member 5a to be pushed in/pulled out without play.

The slide plate 105 includes a larger opening 8 which communicates with said openings 6 and 7, and is so shaped that it can be slideably inserted in the female frame F. There is provided the manipulation lip member 5a projecting in the direction of its slide movement and having a width smaller than the slide plate 105.

The slide plate 105 of the above construction is inserted between the first and the second plates 103 and 104 in a manner that will allow the lip member 105 to stick out from between said stopper strips 23, 23. The catches 11 are either assembled, with respect to FIG. 14A, by deform in the same manner as in the first embodiment or, with respect to FIG. 14B, by welding in the same manner as in the first embodiment.

The stopper strips 23 of the second plate 104 abut against the lobes 3e of the first plate 103, so that the edge 21a of the dented portion 21 in the first plate 103 and the edge 4c of the second plate 104 are arranged substantially on the same plane.

When the lip member 5a of the slide plate 105 inserted in the female frame F is caused to move out of the frame F, a shoulder 27 of the lip member 5a will abut against the stopper strips 23. The lip member 5a is so shaped that it will stick out as little as possible from the line connecting the tip ends of the lobes 3e, 3e when said stopper strips 23 rest against the shoulder 27.

The positional relation of the opening 8 of the slide plate 105 and openings 6 and 7 of the first and the second plates 103, 104 of the female frame F respectively is the same as that in the first embodiment. The opening 8a is wider in the direction toward the lip member 5a. The peripheral edge 8c is on the side of the opening 8a separated from the peripheral edges of the openings 6, 7 while the peripheral edge 8b is provided near said edges of the openings 6 and 7.

The plate portion 3b of the first plate 103 is attached to the base material D, to which is attached the fixing plate 25 having holes 25*a*. Pins with a head each are inserted through the holes 25*a* to connect the female member B-4 to the base material by compressing the other end of the pin.

The fastener means according to this embodiment is engaged/detached and manipulated in the same manner as in the first embodiment. Description is therefore omitted.

According to the fourth embodiment, the lip member 5*a* of the slide plate 105 is merely exposed in the dented portion 21 of the plate 103 and does not substantially stick out from the line connecting the tip of the lobes 3*e*, 3*e*. This arrangement facilitates pressing of the slide plate inside the dented portion 21 and prevents unexpected slipping out of the lip member 5*a*.

In the embodiments described above, the catches 11, 11' are provided on either the first or the second plate 103 or 104, and the slot 10, 10' are provided on either the first or the second plate 103 or 104. Catches 11, 11' and the slots 10, 10' may be provided on the sides 3*a* of the first plate 103 and corresponding catches and slots 10, 10' and 11, 11' on the second plate 4, 104 as well.

It should be noted that the present invention is in no way limited by these embodiments. It is therefore possible to provide a tab on the slide plate inserted in the female frame so that the tab will project outside the female frame.

It is also possible to provide an opening in the female frame so as to manipulate the slide plate through this opening.

According to the present invention, the first plates 3, 103 and the second plates 4, 104 can be easily and accurately engaged by inserting the catches 11, 11' into the slots 10, 10'. By causing the catches 11, 11' to deform such as by bending or pressing, the first and the second plates 3, 103 and 4, 104 respectively are firmly and easily engaged.

Moreover, this invention is advantageous in that welding can be easily and precisely performed without making errors in positioning as are fitted into the slots 10, 10' to assemble the first and the second plates 3, 103 and 4, 104 before welding.

The present invention features these and other various advantages.

What I claim is:

1. A fastener comprising:

a male member having a magnetic projection, said projection having a recess; and a female member having a female frame comprising:

a first and a second plate members; and a ferromagnetic slide plate slideably situated between said first and the second plate members, said slide plate capable of being manipulated from the outside of the female frame, wherein said first and the second plate members and said slide plate have communicating openings through which said projection of the male member is inserted, wherein said recess in said projection is maintained in engagement with one of peripheral edges of said slide formed by the opening in said slide plate by magnetism produced by said projection when said projection is inserted through said openings.

2. The fastener according to claim 1, wherein said first and second plate members are held together by welding.

3. The fastener according to claim 1, wherein said first and second plate members are held together by deforming one of said first and second plate members.

4. The fastener according to claim 1, wherein said first plate member of said female frame includes two opposing sides that are bent inward along its edges, and having one of slots and catches on the upper ends of said opposing sides, and said second plate having on its opposing side edges the other of catches and slots, wherein said catches and slots form joints to align said first and second plate members.

5. The fastener according to claim 4, wherein said first plate member is provided with slots and said second plate member is provided with catches, wherein said catches are deformed against said first plate to securely hold said first and second plate members.

6. The fastener according to claim 4, wherein said first plate member is provided with catches and said second plate member is provided with slots, wherein said catches are deformed against said second plate to securely hold said first and second plate members.

7. The fastener according to claim 4, wherein said first plate member is provided with slots and said second plate member is provided with catches, wherein said catches are welded to said slots to securely hold said first and second plate members.

8. The fastener according to claim 4, wherein said first plate member is provided with catches and said second plate member is provided with slots, wherein said catches are welded to said slots to securely hold said first and second plate members.

9. The fastener according to claim 1, wherein at least one of said first and second plate members is made of a ferromagnetic material.

10. The fastener according to claim 1, wherein said first and the second plate members are made of a non-ferromagnetic material.

11. The fastener according to claim 1, wherein said projection is a projection shaft.

12. The fastener according to claim 11, wherein said projection shaft is formed of a permanent magnet.

13. The fastener according to claim 11, wherein said projection shaft is formed of a permanent magnet comprising plastic.

14. The fastener according to claim 11, wherein said projection shaft is made of a non-ferromagnetic material, and includes a permanent magnet formed within said shaft.

15. The fastener according to claim 11, wherein said projection shaft is formed of a ferromagnetic material and includes a permanent magnet formed within said shaft.

* * * * *